United States Patent [19]

Sexton et al.

[11] Patent Number: 4,625,914

[45] Date of Patent: Dec. 2, 1986

[54] ROTARY DRIVE SPRINKLER

[75] Inventors: Timothy C. Sexton, Walnut, Calif.; George H. Lockwood, Wilton Manors, Fla.; David E. Robertson, Covina; Joseph D. Mason, Monteclair, both of Calif.; Mark J. Mattson, San Dimas; Robert W. Patterson, LaVerne, both of Calif.

[73] Assignee: Rain Bird Consumer Products Mfg. Corp., Glendora, Calif.

[21] Appl. No.: 735,071

[22] Filed: May 16, 1985

[51] Int. Cl.[4] ..... B05B 3/16; B05B 3/04

[52] U.S. Cl. ..... 239/206; 239/241; 239/242; 415/152 R

[58] Field of Search ..... 239/206, 242, DIG. 1, 239/230, 240, 241; 251/74; 137/119, 624.14; 415/152 R

[56] References Cited

U.S. PATENT DOCUMENTS

| | | | |
|---|---|---|---|
| 1,919,247 | 7/1933 | Munz . | |
| 1,921,020 | 8/1933 | Birrell . | |
| 2,985,380 | 5/1961 | Rosenkranz | 239/183 |
| 3,107,056 | 10/1963 | Hunter | 239/206 |
| 3,117,724 | 1/1964 | Ray | 239/97 |
| 3,263,930 | 8/1966 | Friedmann et al. | 239/200 |
| 3,526,363 | 9/1970 | Hauser . | |
| 3,583,638 | 6/1971 | Eby | 239/200 |
| 3,602,431 | 8/1971 | Lockwood | 239/101 |
| 3,645,451 | 2/1972 | Hauser | 239/206 |
| 3,702,676 | 11/1972 | Hauser | 239/206 |
| 3,785,565 | 1/1974 | Perry et al. | 239/206 |
| 3,854,664 | 12/1974 | Hunter . | |
| 3,888,417 | 6/1975 | Harmon | 239/97 |
| 3,930,618 | 1/1976 | Lockwood | 239/230 |
| 3,934,820 | 1/1976 | Phaup | 239/205 |
| 4,026,471 | 5/1977 | Hunter | 239/206 |
| 4,182,494 | 1/1980 | Wichman | 239/230 |
| 4,253,608 | 3/1981 | Hunter | 239/206 |
| 4,417,691 | 11/1983 | Lockwood | 239/206 |

*Primary Examiner*—Joseph F. Peters, Jr.
*Assistant Examiner*—Kevin Patrick Weldon
*Attorney, Agent, or Firm*—Kelly, Bauersfeld & Lowry

[57] ABSTRACT

An improved rotary drive sprinkler is provided for rotatably driving a pop-up spray head in a stepwise manner through a full-circle or reversibly within a selected part-circle path. The sprinkler includes a reversing trip mechanism having a pair of spaced-apart stops rotatable with the spray head and defining preset end limits of a part-circle path, wherein a stationary trip wire is engageable with the stops to switch an internal rotary drive assembly, such as a ball drive assembly, between forward- and reverse-drive operation. The trip wire flexes to accommodate forced spray head rotation to a maladjusted position beyond the end limits and, upon subsequent sprinkler operation, rides over ramped surfaces on the stops for automatic return to reversible operation between the reset end limits. Alternatively, the stops can be set in side-by-side relation with their ramped surfaces oriented for the trip wire to ride resiliently thereover without switching of the rotary drive assembly. Positional adjustment of the stops is performed quickly and easily from the exterior of the sprinkler after which a vandal-resistant lock device can be installed to prevent inadvertent or unauthorized stop adjustment. In addition, flow of irrigation water through the sprinkler is regulated to obtain improved control over spray head rotational speed irrespective of water pressure and spray head nozzle size.

60 Claims, 26 Drawing Figures

FIG. 13
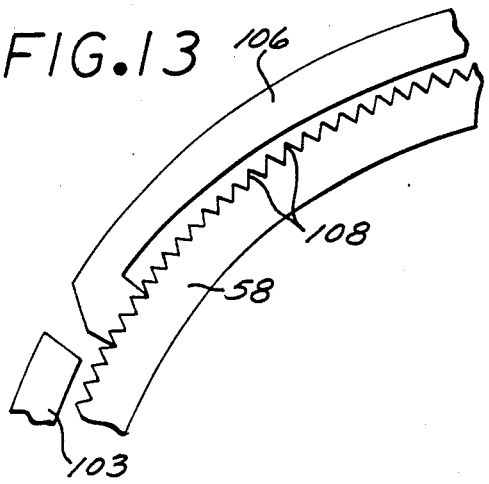
FIG. 14
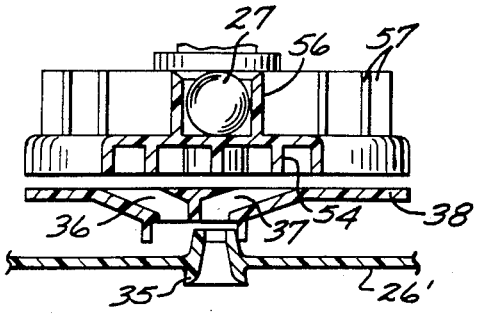
FIG. 15
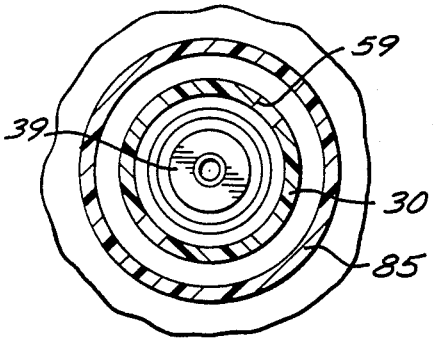
FIG. 16
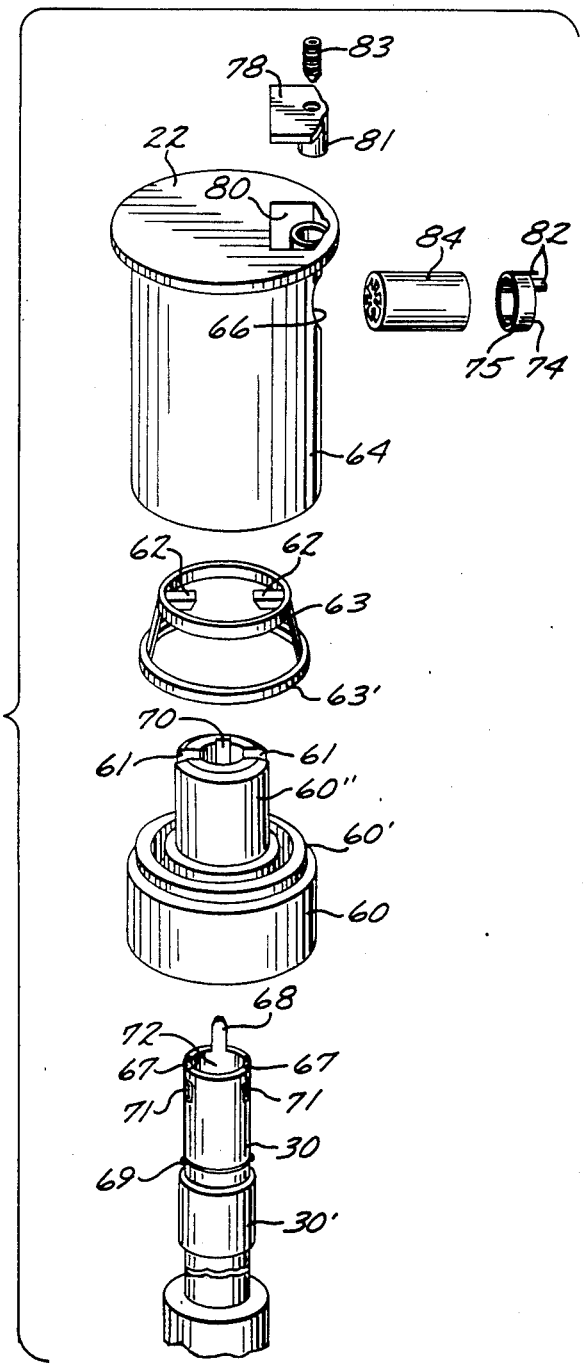
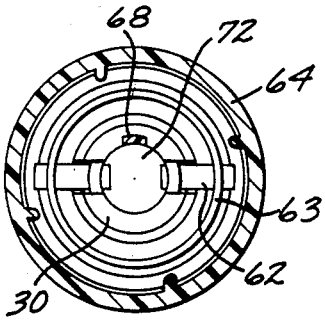
FIG. 17

FIG. 24
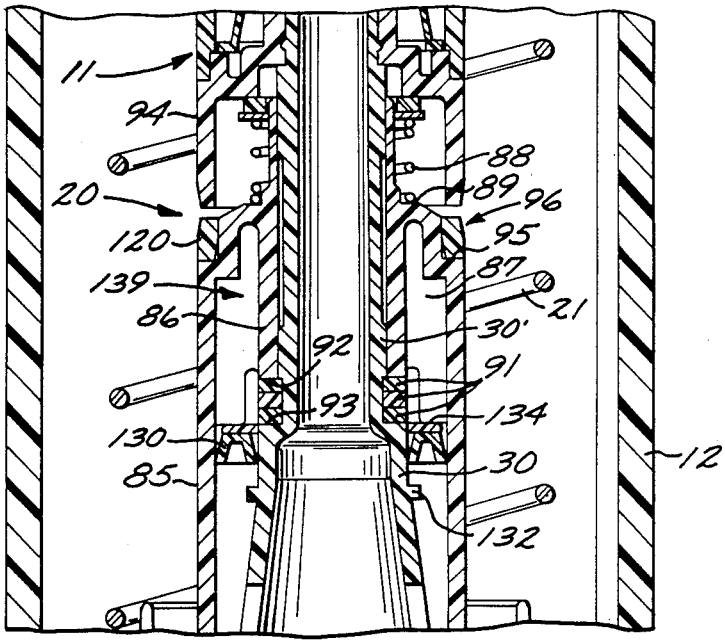
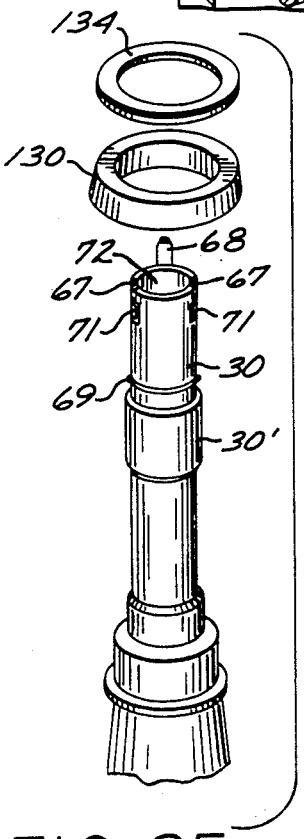
FIG. 25
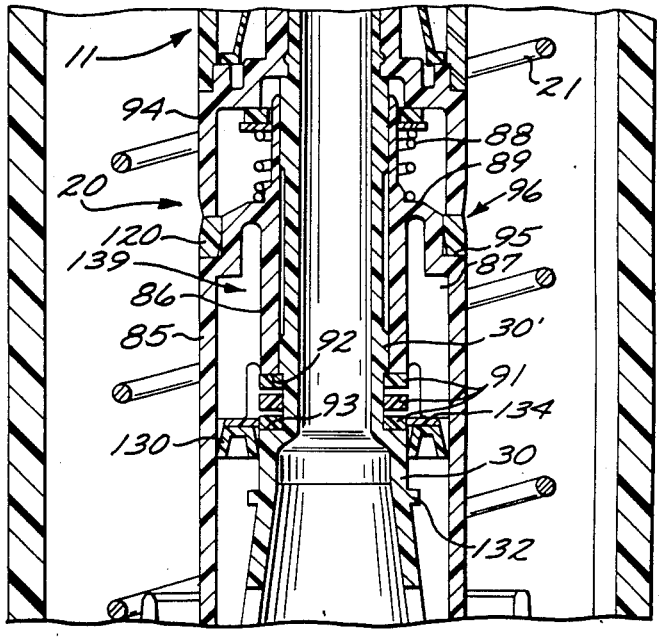
FIG. 26

ROTARY DRIVE SPRINKLER

BACKGROUND OF THE INVENTION

This invention relates generally to irrigation water sprinklers of the type having a sprinkler spray head driven rotatably through a full- or adjustably set part-circle path, and particularly of the type having rotary drive components encased within a substantially closed sprinkler housing concealed from exposure to wind, sand, and the like. More specifically, this invention relates to an irrigation sprinkler including an improved reversing trip mechanism designed to accommodate forced maladjustment without component breakage or deviation from a preset adjustment condition, and further including water flow regulation means for improved control over spray head rotary speed regardless of water pressure or spray head nozzle size.

A wide variety of irrigation water sprinklers are known in the art for projecting or spraying a stream of water over a prescribed adjacent terrain area to irrigate lawns, gardens, crops, and the like. Many such sprinklers include a so-called fixed spray head or nozzle from which irrigation water is projected in a stationary pattern, whereas other known sprinkler designs include a rotary drive mechanism for driving a spray head or nozzle typically in a succession of relatively small incremental steps through a full- or reversible part-circle rotation thereby displacing the projected water spray in a stepwise manner over a full- or part-circle terrain area. In both types of sprinklers, the sprinkler spray head is frequently mounted at the upper end of a so-called pop-up stem designed to move the spray head from a retracted position stored within a sprinkler housing to an elevated spraying position when water under pressure is supplied to the sprinkler housing.

Impact drive sprinklers comprise one particularly common type of irrigation sprinkler designed for rotary drive and/or pressure responsive pop-up operation. See, for example, the rotary drive pop-up sprinkler shown and described in U.S. Pat. No. No. 4,182,494. In such sprinklers, an impact drive arm is biased by a spring for oscillatory swinging movement of a deflector unit into repeated interrupting engagement with a water stream discharged from a spray nozzle to impact a sprinkler body in a manner driving the sprinkler through a succession of small rotational steps. Reversing mechanisms are commonly included in such sprinklers to alter the direction of impact drive forces and thereby permit reversible rotation between set end limits of an arcuate part-circle path. However, while impact drive sprinklers of this general type are widely used with highly satisfactory results, the rotary drive and reversing mechanism components are necessarily exposed to the elements including sun, wind, precipitation, sand, grit, and the like. In some environments, this exposure can adversely affect operation and/or contribute to premature failure of the rotary drive or reversing mechanism components. Alternately, such exposure of the sprinkler components renders the sprinkler especially susceptible to unauthorized tampering by vandals including, for example, jamming of rotary drive components or adjustment of part-circle path end limits so that water is sprayed onto unintended areas.

Accordingly, alternative sprinkler designs have been proposed including rotary drive components and/or reversing mechanisms substantially encased and concealed at all times within a sprinkler housing protected against exposure to the environment. See, for example, U.S. Pat. Nos. 4,253,608 and 4,417,691 which disclose reduction gear trains driven by water turbines for rotatably driving the pop-up spray head of a sprinkler. See also U.S. Pat. No. 3,930,618 which discloses a turbine-driven impact ball arrangement for rotatably driving a pop-up sprinkler spray head. However, while these gear-drive and ball-drive sprinklers advantageously improve sprinkler capability to withstand adverse environmental conditions, the reversing mechanisms in such sprinklers generally have not been designed to prevent unauthorized tampering in a structure capable of accommodating attempted forced rotation beyond preset part-circle end limits without component breakage. Moreover, such sprinklers have experienced inconsistent drive mechanism wear rates and/or inconsistent irrigation coverage characteristics due to inadequate control of water flow as a function of pressure and spray head nozzle size.

There exits, therefore, a need for an improved rotary drive sprinkler having a controlled and preferably relatively slow rotary drive stepping speed which can be set substantially independent of water pressure and sprinkler nozzle size, and further including an improved reversing mechanism designed to prevent unauthorized tampering and to accommodate attempted tampering without significant risk of component breakage. The present invention fulfills these needs and provides further related advantages.

SUMMARY OF THE INVENTION

In accordance with the invention, an improved rotary drive irrigation sprinkler has a spray head rotatably driven in a stepwise manner and at a predetermined speed through a full-circle path or reversibly within an adjustably set part-circle path. The sprinkler includes water flow regulation means for controlling the water flow to a rotary drive assembly to maintain the rotary stepping speed of the spray head substantially constant or with minimal controlled speed variation throughout a range of water pressures and in accordance with the particular selected size of a spray head nozzle. The sprinkler further includes an improved reversing trip mechanism designed to prevent unauthorized adjustment by vandals or the like and further to accommodate attempted unauthorized adjustment without breakage of sprinkler components.

In one preferred form of the invention, the improved irrigation sprinkler has the rotary drive assembly, such as a balanced ball drive assembly, mounted within a drive case supported within a sprinkler housing for pop-up movement without rotation relative to the sprinkler housing. A pop-up stem assembly including the rotatable spray head is mounted on the drive case and this entire pop-up unit is biased by a retraction spring toward a normal stored position retracted substantially into the housing. Entry of irrigation water under pressure into the sprinkler housing via a lower end inlet displaces the drive case and stem assembly toward a popped-up position with the spray head elevated above the sprinkler housing and rotatably driven in a succession of small steps by the rotary drive assembly.

The rotary drive assembly includes a water turbine driven rotatably in a forward- or reverse-drive direction by a portion of the irrigation water passing through drive jet nozzles in the drive case and further through forward- or reverse-drive swirl ports in a movable swirl plate. The turbine centrifugally carries two or more symmetrically disposed impact balls into repeated impact with symmetric anvils carried by a rotatable drive sleeve of the pop-up stem assembly. This repeated impact of the balls with anvils displaces the drive sleeve through a succession of small rotational steps to correspondingly drive the spray head mounted at the upper end of the drive sleeve.

The flow of water passing through the drive jet nozzles is regulated for a given spray head nozzle size by a pair of bypass ports mounted in parallel flow relation with each other and with respect to the drive jet openings. These bypass ports permit bypass flow of a substantial portion of the water around the rotary drive assembly for direct flow to the spray head. One of these bypass ports includes a spring-loaded pressure compensating valve, whereas the other bypass port includes a bypass bushing having a flow opening therein of selected size in accordance with the size of the spray head nozzle. The pressure compensating valve and the bypass bushing cooperate with the spray head nozzle to maintain turbine and spray head drive speed at a relatively slow rate selected for substantially optimum projected stream range and substantially minimum mechanical wear yet permitting use of different spray head nozzle sizes to meet different irrigation requirements.

The reversing trip mechanism comprises a pair of stops carried respectively by an inner drive ring on the drive sleeve and a movable outer trip ring or the like carried about the drive sleeve as by ratcheted engagement therewith. The stops define a pair of generally upright trip surfaces facing one another at opposite end limits of a part-circle arcuate path of sprinkler rotation and are engageable by a resilient or flexible trip wire constrained against rotation with the drive sleeve. The trip wire protrudes between the stops for engagement with one stop as the sprinkler rotates to one end limit of the preset arcuate path to switch the swirl plate to an alternate position reversing the swirl direction of the water flowing to the turbine thereby reversing the direction of sprinkler rotation until the trip wire engages the other stop to again reverse the direction of sprinkler operation. Upon forced rotation of the spray head and drive sleeve beyond either end limit, the trip wire bends without breakage to permit such forced rotation. Subsequent sprinkler operation rotatably drives the spray head and drive sleeve through a part-circle path outside the preset end limits bringing the trip wire into contact with ramped surfaces on the stops wherein said ramped surfaces each face away from the associated upright trip surface. The trip wire flexes sufficiently to ride over either ramped stop surface without switching swirl plate position to return the sprinkler to its preset arcuate part-circle path.

The position of the stop on the movable outer trip ring is adjustable relative to the stop on the inner drive ring to adjust the magnitude of the preset arcuate part-circle path. More particularly, the spray head and drive sleeve are vertically movable through a short stroke relative to a nonrotating riser projecting upwardly from the drive case and forming another portion of the pop-up stem assembly. Downward displacement of the spray head and drive sleeve through this short stroke carries the outer trip ring downwardly for engagement of one or more lugs thereon with radially open notches formed in the drive case to lock the outer trip ring against rotation with the inner drive ring. The drive sleeve including the inner drive ring can then be rotated to rotationally displace the drive sleeve stop relative to the outer trip ring stop, after which the spray head and drive sleeve are returned preferably by spring action through the short stroke to release the trip ring lugs from the drive case notches. In one position of adjustment, the stops can be oriented in side-by-side relation with their upright trip surfaces disposed face-to-face for full-circle sprinkler rotation with the trip wire riding in either direction over the ramped surfaces of the stops without switching the swirl plate position. A lock device, such as a locking collar, can be seated within an annular recess between the upper end of the riser and the spray head to lock the spray head and drive sleeve against subsequent downward movement through the short stroke thereby locking the sprinkler against unauthorized adjustment of the end limit stops.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 13 is an enlarged fragmented portion illustrated generally as region 13 in FIG. 10 and showing ratcheted engagement between adjustable trip rings of the reversing trip mechanism;

FIG. 14 is an enlarged fragmented vertical sectional view similar to FIG. 9 but illustrating the ball drive assembly switched to an alternative state for reverse drive rotation of the pop-up stem assembly;

FIG. 15 is a fragmented vertical sectional view taken generally on the line 15—15 of FIG. 5;

FIG. 16 is an enlarged fragmented exploded perspective view illustrating assembly of portions of the pop-up stem assembly including the spray head for the sprinkler;

FIG. 17 is a horizontal sectional view taken generally on the line 17—17 of FIG. 3;

FIG. 24 is an enlarged fragmented vertical sectional view similar to a portion of FIG. 3 but illustrating an alternative form of the sprinkler including improved seal means incorporated into the pop-up stem assembly;

FIG. 25 is a fragmented exploded perspective view illustrating assembly of portions of the pop-up stem assembly of FIG. 24; and FIG. 26 is a fragmented vertical sectional view similar to FIG. 24 but illustrating operation of the improved seal means during adjustment of a reversing trip mechanism.

DETAILED DESCRIPTION OF THE PREFERRED EMBODIMENT

Figure 1:
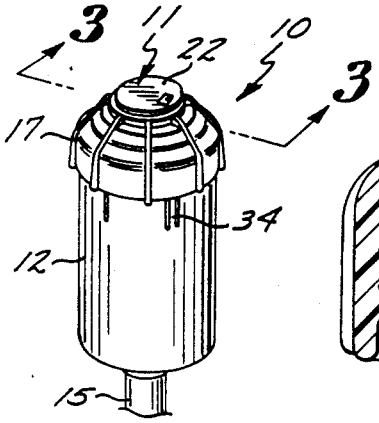
FIG. 1 is a perspective view illustrating an improved rotary drive sprinkler embodying the novel features of the invention and illustrating a pop-up spray head in a stored position retracted within a sprinkler housing.
Figure 2:
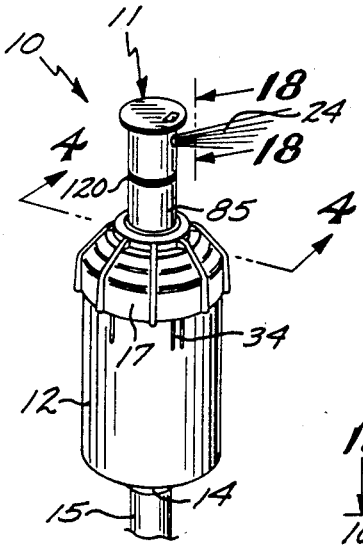
FIG. 2 is a perspective view similar to FIG. 1 but illustrating the pop-up spray head in a spraying position elevated above the sprinkler housing.

As shown in the exemplary drawings, an improved rotary drive sprinkler referred to generally by the reference numeral 10 includes a pop-up spray head 11 movable between a retracted position shown in FIG. 1 stored substantially within a sprinkler housing 12 and a spraying position elevated above the housing as shown in FIG. 2. The spray head 11 is rotatably driven in a stepwise manner by a water-powered rotary drive assembly 13 (FIG. 3) encased within the sprinkler housing 12 in a position protected against exposure to the surrounding environment and further protected against direct access by vandals and the like.

In accordance with the invention, the rotary drive assembly 13 is adapted for selected full-circle or adjustable reversible part-circle rotary driving of the spray head 11, with an improved reversing trip mechanism being provided to resist unauthorized adjustment and to accommodate attempted forced adjustment without risk of component breakage. Moreover, the rotary drive assembly 13 includes simplified water flow regulation means for maintaining spray head rotational driving speed at a relatively slow rate for substantially minimum mechanical wear. Advantageously, these features are provided in a sprinkler construction adapted for manufacture predominantly from lightweight molded plastic or the like and desigend for facilitated assembly.

Figure 3:
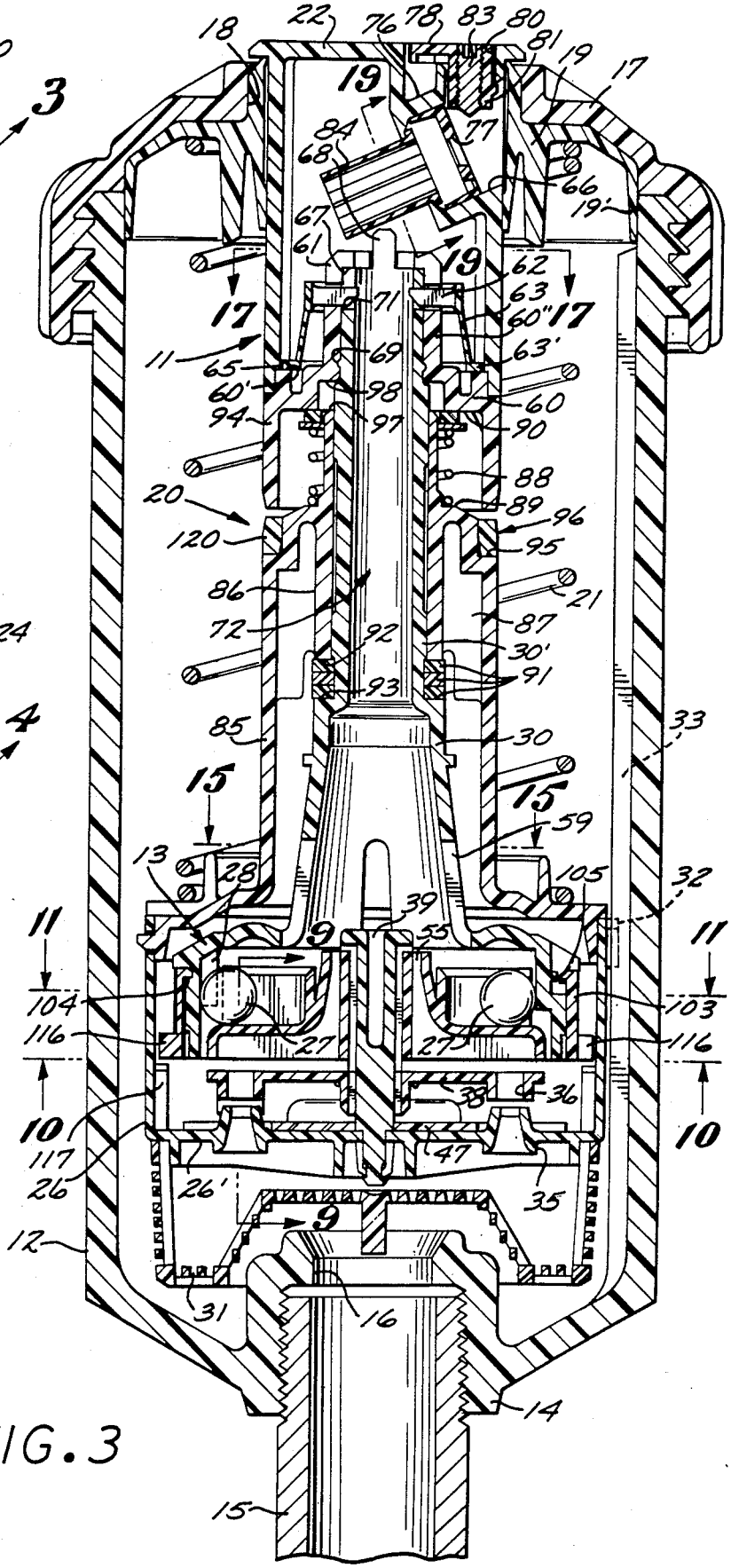
FIG. 3 is an enlarged vertical sectional view taken generally on the line 3—3 of FIG. 1 to illustrate construction details of a ball-type rotary drive assembly and pop-up stem assembly for carrying and rotatably driving the pop-up spray head.

As shown generally in FIGS. 1 and 2 and more specifically in FIG. 3, the sprinkler housing 12 has a relatively conventional, upright cylindrical shape formed typically from a lightweight molded plastic or the like. An inlet fitting 14 is formed at the lower end of the housing 12 and is adapted for connection to the end of a water supply pipe 15 through which irrigation water under pressure is supplied normally under the control of a remotely located control valve (not shown). The water flows into the housing interior through an inlet opening 16 (FIG. 3) with the upper end of the sprinkler housing 12 being typically threaded or the like for removable connection of a housing cap 17 having a central opening 18 through which the spray head 11 moves between the retracted and elevated positions. An annular seal member 19 of flexible molded seal material or the like is seated within the cap central opening and conveniently includes an outer annular flange 19' overlapping the juncture between the housing 12 and the cap 17 to prevent water leakage at that location without requiring use of any other seal means or device.

Figure 4:
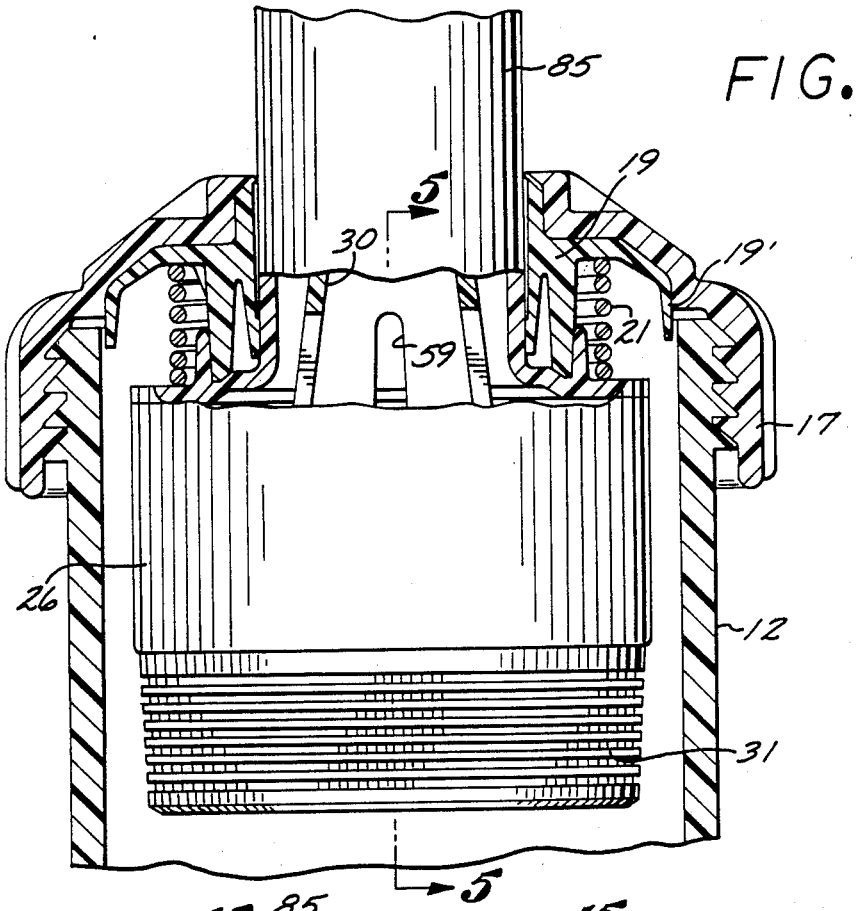
FIG. 4 is an enlarged fragmented vertical sectional view, shown partially in side elevation, and taken generally on the line 4—4 of FIG. 2 to illustrate the ball drive and pop-up stem assemblies in the elevated spraying position.
Figure 5:
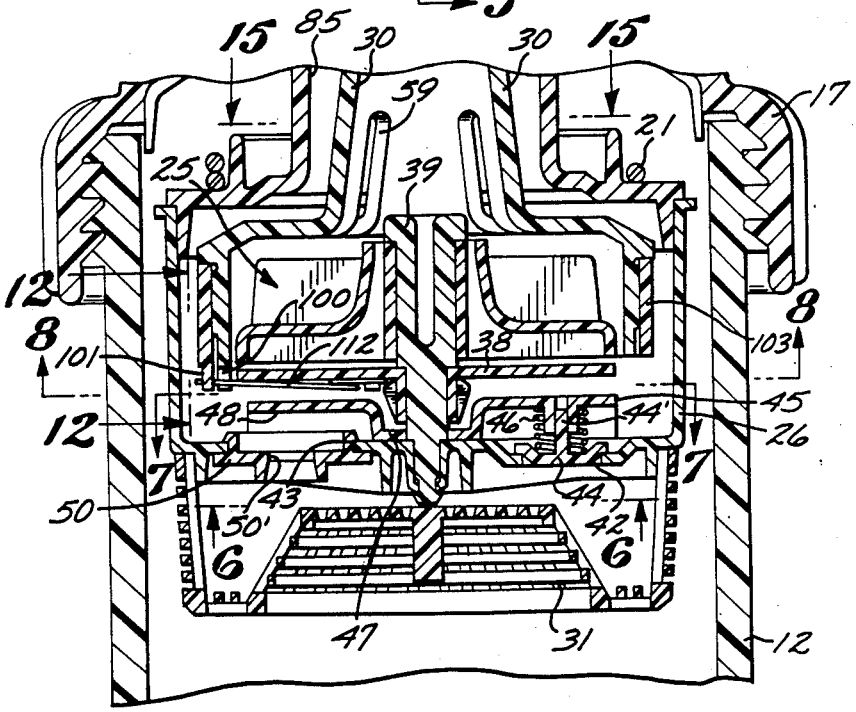
FIG. 5 is a fragmented transverse vertical sectional view taken generally on the line 5—5 of FIG. 4.

The spray head 11 of the sprinkler 10 is mounted at the upper end and comprises a portion of a pop-up stem assembly 20, as shown in FIGS. 3–5. The pop-up stem assembly is supported in turn at its lower end by the rotary drive assembly 13, with the pop-up stem and rotary drive assemblies comprising a pop-up unit carried within the sprinkler housing for sliding movement between the retracted position (FIG. 3) and the elevated spraying position (FIGS. 4 and 5). A retraction spring 21 such as a helical compression spring is coiled about the pop-up stem assembly 20 and reacts between the seal member 19 at the underside of the housing cap 17 and an upwardly presented surface at the lower end of the pop-up stem assembly 20 to urge the entire pop-up unit normally toward the retracted position. When retracted, a spray head cover 22 on the spray head 11 has its peripheral margin seated upon the axially upper end of the seal member 19 about the cap central opening 18. As is known in the art, the spray head cover 22 is desirably formed with a relatively smooth-surfaced contour making it difficult to grasp manually when the spray head is in the retracted position, thereby resisting unauthorized tampering when the sprinkler is not operating.

When irrigation water under pressure is supplied to the sprinkler housing 12 via the lower inlet opening 16, the pressure of the water overcomes the downward biasing force of the retraction spring 21 causing the rotary drive assembly 13 and the pop-up stem assembly 20 to displace upwardly to the elevated spraying position shown in FIGS. 4 and 5. In this position, a portion of the water supplied to the sprinkler is directed into driving relation with the rotary drive assembly 13 to rotatably drive the spray head 11 through a succession of relatively small rotational steps, as will be described in more detail. This drive portion of the water is recombined with the remaining or bypass water portion for projection outwardly from the spray head 11 as an irrigation water stream 24, as shown in FIG. 2, which is thus swept in a series of small rotational steps over adjacent terrain for irrigation purposes.

The rotary drive assembly 13 comprises, in the exemplary embodiment a balanced ball drive assembly having a water-driven turbine or impeller 25 mounted for rotation within a drive case 26 and carrying at least two symmetrically disposed impact balls 27 for repetitive, substantially simultaneous impact with anvils 28 on a rotatably mounted drive sleeve 30 forming a portion of the pop-up stem assembly 20. The succession of ball impacts with the anvils 28 rotatably drives the drive sleeve 30 through a succession of relatively small rotational steps to correspondingly rotate the spray head 11 mounted at the upper end of said drive sleeve 30.

More particularly, with reference to FIGS. 3–5, the drive case 26 has a generally cup-shaped configuration which can be formed conveniently and economically from a suitable lightweight molded plastic. The drive case 26 includes a lower wall 26' supporting the water regulation means for controlled flow of the drive water portion into driving relation with the ball drive assembly and for regulated bypass of the remaining water around the ball drive assembly. A cup-shaped perforate filter screen 31 is conveniently seated by friction fit or other suitable attachment means over the lower end of the drive case 26 for movement therewith within the sprinkler housing 12, wherein the filter screen 31 blocks entry of sand or other grit and particulate into communication with moving components of the drive assembly. One or more radially outward projecting keys 32 (FIG. 3) are formed on the drive case 26 for registry with one or more associated keyway slots 33 extending vertically within the sprinkler housing 12 to limit the drive case 26 to vertical up and down movement without rotation. This key 32 and keyway slot 33 also insure mounting of the drive case 26 in a predetermined rotation attitude within the sprinkler housing 12 and relative to external indicia such as a pair of raised ribs 34 (FIGS. 1 and 2) on the housing for purposes to be described in more detail.

Figure 9:
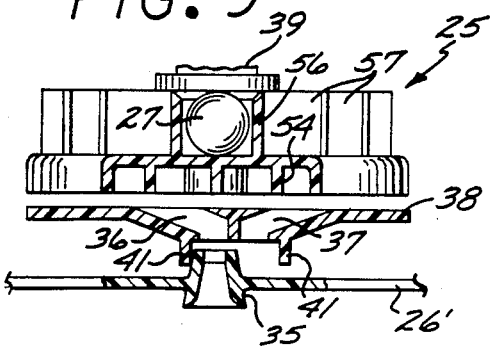
FIG. 9 is an enlarged fragmented vertical sectional view taken generally on the line 9—9 of FIG. 3.
Figure 8:
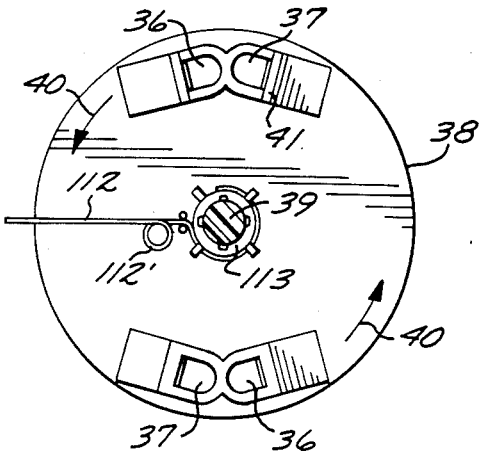
FIG. 8 is still another horizontal sectional view taken generally on the line 8—8 of FIG. 5.

The lower wall 26' of the drive case 26 is shaped to define a diametrically opposed pair of drive jet nozzles or ports 35 for upward passage of a pair of relatively high velocity drive jets into driving relation with the ball drive assembly. As shown in FIGS. 3, 8, and 9, the drive jets are each directed upwardly toward an overlying respective set of adjacent swirl ports 36 and 37 formed near the periphery of a generally circular swirl plate 38. This swirl plate 38 is rotatably supported within the drive case 26 by an upstanding spindle 39 having a foot anchored by snap-fit engagement or the like into the drive case lower wall 26'. Each set of swirl ports 36 and 37 comprises a pair of contoured openings, one of which is aligned for receiving the associated upwardly directed drive jet and for turning the drive jet in a generally circumferential direction within the drive case 26. For example, as shown in FIGS. 8 and 9, the swirl ports 36 are arcuately shaped to swirl the drive jet water flow circumferentially in the direction depicted by arrows 40 when said swirl ports 36 are aligned with the underlying drive jet nozzles 35, whereas the other two swirl ports 37 are arcuately shaped to swirl the drive jet water flow in an opposite circumferential direction when aligned with the drive jet nozzles. Spaced limit tabs 41 project downwardly from at least one of the swirl port sets for engagement with an upstanding portion of the underlying drive jet nozzle 35 (FIG. 9) to restrict rotation of the swirl plate 38 between a forward-drive position with the swirl ports 36 aligned above the drive jet nozzles 35 and a reverse-drive position with the swirl ports 37 aligned above said drive jet nozzles 35.

Figure 6:
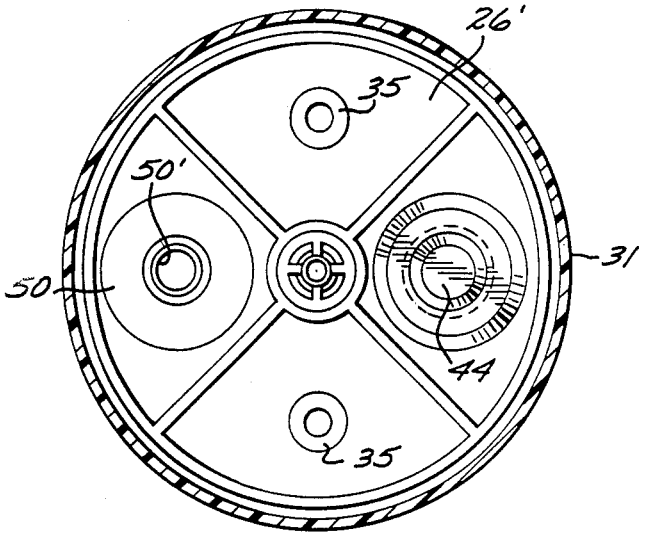
FIG. 6 is a horizontal sectional view taken generally on the line 6—6 of FIG. 5.
Figure 7:
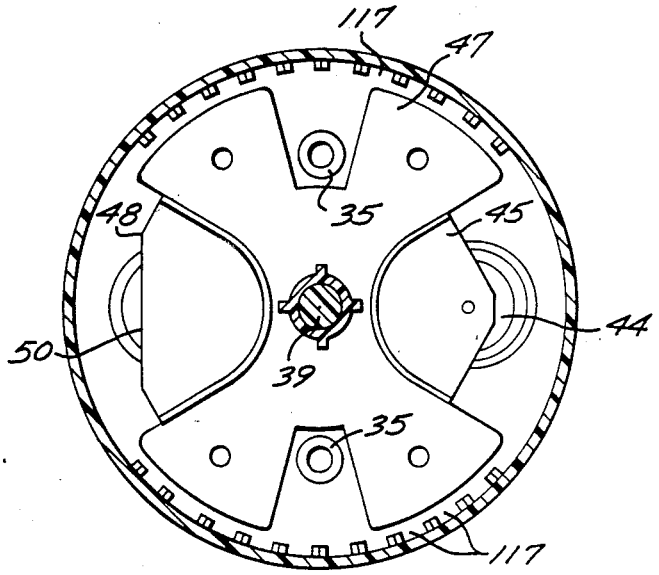
FIG. 7 is another horizontal sectional view taken generally on the line 7—7 of FIG. 5.

The lower wall 26' of the drive case 26 further includes a diametrically opposed pair of bypass flow ports 42 and 43, as shown in FIGS. 5–7. Water flow through the bypass flow port 42 is regulated by a pressure-compensating valve 44 having a valve stem 44' slidably seated within a radially outwardly open hood 45 anchored by a base 47 to the drive case lower wall 26' (FIG. 7) and spaced above the underlying port 42. A valve spring 46 having selected spring rate characteristics biases the pressure-compensating valve 44 in a downward direction toward a position normally closing the flow port 42. A similar radially outwardly open hood 48 is supported in a position spaced above the other bypass flow port 43 within which is seated a removable flow control bushing 50 having a flow opening 50' formed therein of selected size in accordance with the size of a nozzle in the sprinkler spray head 11, for purposes to be described herein in more detail. The hoods 45 and 48, however, function to guide the bypass water flow in a generally radially outward direction at the bottom of the drive case 26 and beneath the swirl plate 38 for upward bypass flow around the water turbine 25, while the pressure-compensating valve 44 and the bushing flow opening 50' cooperatively regulate the flow of water passing through the drive jet nozzles 35.

Figure 10:
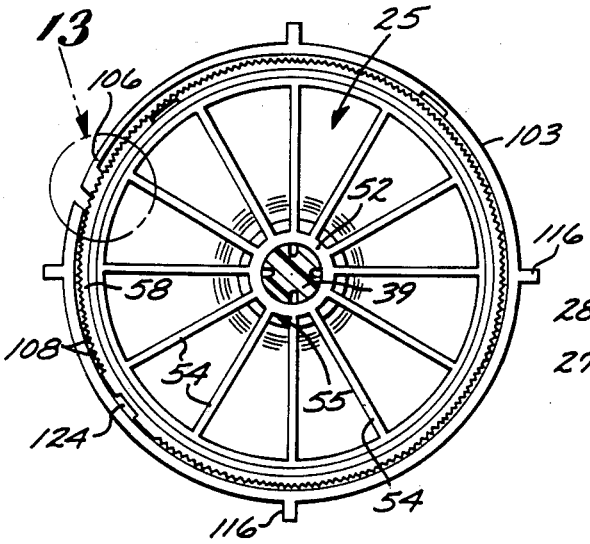
FIG. 10 is a horizontal sectional view taken generally on the line 10—10 of FIG. 3.

As shown in FIGS. 9 and 10, the water turbine 25 comprises a generally shell-shaped body oriented to open in a downward direction and including a central hub 52 rotatably carried about the upright spindle 39 at a position above the swirl plate 38. A plurality of outwardly radiating upright vanes 54 are engaged by the swirling drive jet water discharged with circumferential swirl direction through the swirl ports 36 or 37 depending upon the position of the swirl plate 38, thereby rotatably driving the water turbine 25. This driving water flow exits from communication with the turbine 25 in a radially outward direction for recombining with the bypass flow or, alternately, the driving water flow is guided upwardly by the shape of the turbine body for discharge passage through an annular array of throat openings 55 surrounding the central hub 52 and further upwardly toward the pop-up stem assembly 20.

Figure 11:
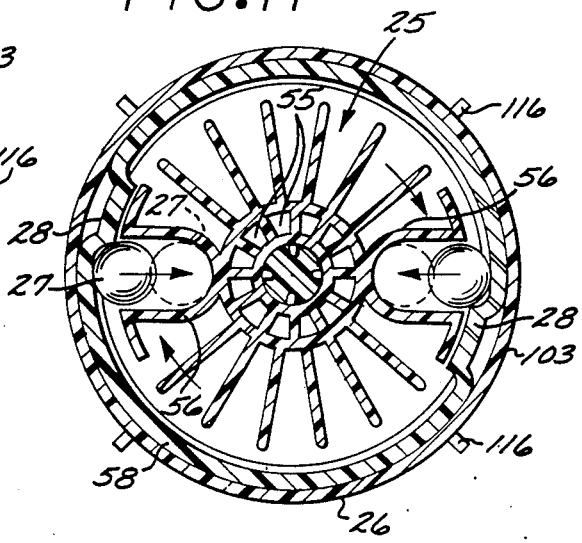
FIG. 11 is another horizontal sectional view taken generally on the line 11—11 of FIG. 3.

The upper surface of the shell-shaped turbine body supports a symmetrically disposed pair of radially outwardly open ball tracks 56 which are thus rotated along with the water turbine 25 within the drive case 26. These ball tracks 56 respectively carry the impact balls 27 sized for relatively free radial sliding motion within the tracks 56. Accordingly, water-driven rotation of the turbine 25 throws the impact balls 27 radially outwardly toward their solid line positions as illustrated in FIGS. 3 and 11 to ride relatively smoothly along the predominantly smooth inner diameter surface of an annular drive ring 58 formed as a radially enlarged lower end of the rotatable drive sleeve 30. This annular drive ring 58 has its smooth inner diameter surface interrupted by the anvils 28 comprising radial indentations at symmetrically disposed positions for substantially simultaneous impact by the impact balls 27. Such ball-anvil impact causes the balls 27 to displace radially inwardly toward the dotted line positions depicted in FIG. 11 to clear the anvils 28 which are rotationally shifted through a small rotational step as a result of the ball impact, with the magnitude of the rotational step being a function of the masses of the balls which are formed from a metal, such as stainless steel or the like. Continued water turbine rotation thus repetitively carries the impact balls 27 into a simultaneous force-balanced impact with the symmetric anvils to rotate the drive sleeve 30 through a succession of relatively small rotational steps.

The drive sleeve 30 narrows at a position spaced slightly above the impact balls 27 and their associated tracks 56 and then projects upwardly from the drive case 26 for connection to the spray head 11. The drive jet water discharged upwardly through the turbine throat openings 55 is collected within the lower region of the drive sleeve 30 together with the remaining flow water which enters the drive sleeve through vertically elongated flow slots 59, as shown in FIGS. 5 and 15.

The spray head 11 comprises a preassembled unit conveniently adapted for snap-fitted mounting directly onto the upper end of the drive sleeve 30 in a selected rotational position with respect to the drive sleeve 30. More particularly, as shown best in FIGS. 3, 16, and 17, the illustrative spray head 11 comprises a generally cylindrical base 60 with diametrically opposed notches 61 in a reduced diameter upper end for rotationally prealigned reception of radially inwardly projecting snap tabs 62 on a retainer cage 63. A generally cylindrical spray head housing 64 is received over the spray head base 60 and includes internal shoulders 65 (FIG. 3) for seating a lower rim 63' of the retainer cage 63 firmly upon an enlarged lower end seat 60' of the spray head base 60. The spray head housing 64 is rotationally positioned on the spray head base 60 to orient a laterally open nozzle port 66 in a selected azimuthal direction relative to the snap tabs 62, after which these components are securely fastened together by means of a sonic weld, adhesive or the like. The thus-assembled spray head 11 is then mounted quickly and easily over the upper end of the drive sleeve 30 to lock an upwardly protruding drive lug 68 on the sleeve 30 within a drive keyway 70 formed in the spray head base 60, with a crush seal 69 on the drive sleeve engaging the interior of a reduced diameter upper end 60'' of the base 60. In addition, the snap tabs 62 of the retainer 63 slide over angled surfaces 67 on the drive sleeve upper end for snap-fit reception into cutouts 71 formed near the upper end of the drive sleeve 30. The water flowing into the drive sleeve passes through an upwardly open bore 72 and is discharged upwardly into the interior of the assembled spray head 11, the upper end of which is closed by the cover 22.

Figure 19:
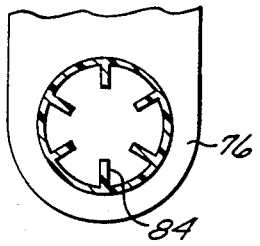
FIG. 19 is a fragmented sectional view taken generally on the line 19—19 of of FIG. 3.

The spray head 11 carries a spray nozzle through which the irrigation water stream 24 is projected from the sprinkler with a selected geometry for irrigation purposes. In one preferred form, this nozzle comprises a relatively small nozzle disk 74 (FIGS. 3, 16, 18, and 19) formed integrally with a cylindrical nozzle wall 75 sized for relatively close seated sliding reception into a cylindrical nozzle seat 76 defining the nozzle port 66 in the spray head housing 64. Water flowing upwardly from the drive sleeve 30 passes through a primary nozzle orifice 77 of selected size and shape for discharge projection therefrom as the water stream 24. One or more smaller, secondary nozzle orifices 77' may also be provided, if desired, for improved close-range water distribution. A nozzle retainer 78 mounted as by snap-fitting into a cavity 80 in the spray head cover 22 includes a cylindrical boss 81 received between spaced tabs 82 on the nozzle disk 74 to hold the nozzle in place, with said boss 81 supporting a set screw 83 or the like which can be adjusted in position to extend partially into the stream 24 to act as a stream splitter, if desired. In addition, the nozzle seat 76 may support a cylindrical set of antiswirl vanes 84 (FIG. 19) to reduce water swirl flowing to the nozzle orifice 77.

In accordance with one aspect of the invention, the spray head 11 and the underlying drive sleeve 30 are axially movable up and down through a short stroke relative to the drive case 26 and further with respect to a nonrotational riser 85 (FIG. 3) projecting upwardly from the drive case and forming a portion of the pop-up stem assembly. More specifically, the riser 85 has a generally cylindrical shape surrounding a lower portion of the drive sleeve 30 and including an upper guide sleeve 86 of reduced diameter within which the drive sleeve 30 is slidably supported by means of slightly enlarged bearing surfaces 30' or the like. Radial webs 87 (FIG. 1) extend between the outer portion of the riser 85 and the guide sleeve 86 for improved structural strength and concentricity accuracy. A compression spring 88 reacts between an upwardly presented shoulder 89 on the riser guide sleeve 86 and a downwardly presented shoulder 90 on the spray head base 60 to urge the spray head and drive sleeve upwardly within the riser guide sleeve 86. Stacked annular seal bearings 91 interposed between a shoulder 92 at the lower end of the riser guide sleeve 86 and an opposed shoulder 93 on the drive sleeve 30 prevents water leakage therebetween and confines bypass water flow for passage through the slots 59 into the drive sleeve bore 72. An annular skirt 94 conveniently depends from the spray head base 60 to surround and substantially conceal the spring 88 while permitting a limited degree of vertical motion between the lower margin of the skirt 94 and a radially enlarged land 95 on the riser guide sleeve 86. An annular recess 96 is formed axially between the skirt lower margin and the land 95 when the spray head and drive sleeve are in the normal upward position, as viewed in FIG. 1. In this normal upward position a limited axial or vertical space is also provided between the upper end 97 of the guide sleeve 86 and a metering land 98 spaced upwardly from the underside of the spray head base 60.

The lower end of the riser is flared radially outwardly in the vicinity of the drive sleeve slots 59 and in spaced relation with the drive sleeve for convenient and preferably snap-lock attachment to the upper end of the drive case 26 by means of snap-fit tabs and slots, or other suitable fastening means. This flared lower end of the riser 85 supports the lower end of the retraction spring 21 biasing the pop-up stem assembly 20 normally toward the retracted position, as viewed in FIGS. 1 and 3. Accordingly, the riser 85 is secured against rotation within the sprinkler housing 12 along with the drive case 26.

Upon supply of irrigation water under pressure to the sprinkler housing 12, the drive assembly 13 and the pop-up stem assembly 20 together move upwardly within the housing 12 to elevate the spray head 11 vertically above the sprinkler housing, as viewed in FIG. 2. The drive assembly 13 including the impact balls 27 rotationally steps the drive sleeve 30 with the spray head 11 thereon through a succession of relatively small rotational increments to sweep the projected water stream 24 in steps over surrounding terrain requiring irrigation. The parallel disposed bypass ports 42 and 43 cooperatively regulate water flow through the drive jet nozzles 35 in a manner assuring controlled and preferably relatively slow stepping motion irrespective of water inlet pressure to the sprinkler and orifice size of the spray head nozzle orifice 77. That is, the pressure compensating valve 44 and the flow control bushing 50 cooperatively maintain the rotational stepping speed substantially constant or with controlled and preferably decreasing speed in response to increases in inlet water pressure, in accordance with the spring characteristics of the spring 46.

In accordance with a further major aspect of the invention, the reversing mechanism is adjustable quickly and easily to accommodate reversible part-circle sprinkler operation or full-circle operation, all in a manner resistant to unauthorized tampering and further resistance to damage upon attempted tampering. More specifically, the reversing mechanism comprises a pair of stops 100 and 101, as shown best in FIG. 12. The stop 100 is formed integrally with and depends from the lower margin of the enlarged drive ring 58 at the lower end of the drive sleeve 30, whereas the stop 101 is joined via a resilient finger 102 with an outer trip ring 103 carried concentrically about the inner drive ring 58. This outer trip ring 103 is locked against downward displacement on the drive ring 58 by inwardly radiating lips 104 (FIG. 3) projecting into a shallow outer groove 105 in the drive ring 58. Moreover, the outer trip ring 103 is releasably locked against rotation with respect to the drive ring 58 by a resilient pawl 106 having ratchet teeth for engagement with mating ratchet teeth 108 on the exterior of the drive ring, as shown in FIG. 13.

Figure 12:
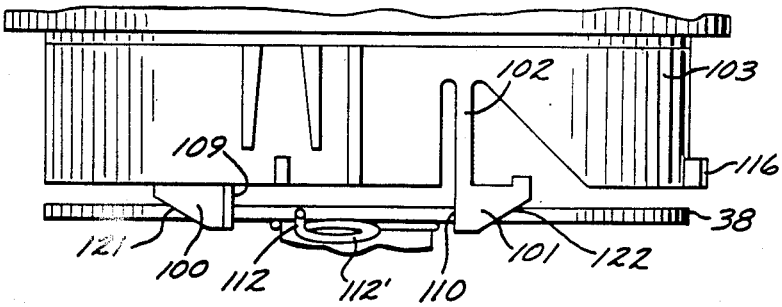
FIG. 12 is an enlarged fragmented vertical sectional view taken generally on the line 12—12 of FIG. 5 and illustrating construction details of a reversing trip mechanism in one position of adjustment for part-circle sprinkler operation.
Figure 18:
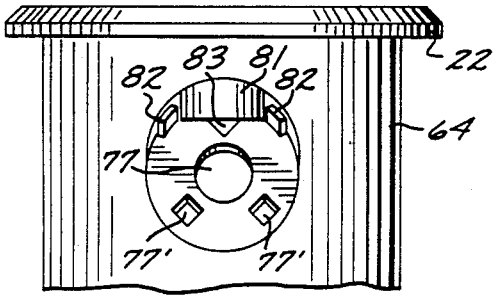
FIG. 18 is an enlarged fragmented elevation view of the spray head in the elevated spraying position, taken generally on the line 18—18 of FIG. 2.

The two stops 100 and 101 are normally positioned in spaced-apart relation, as viewed in FIG. 12, with upright stop surfaces 109 and 110 respectively facing one another. A resilient trip wire 112 having an inner end achored about a central boss 113 of the swirl plate 38 protrudes outwardly to a position circumferentially between the stops 100 and 101. For increased resiliency, this trip wire 112 preferably includes an intermediate loop 112' disposed along its length, as shown in FIGS. 8 and 12.

In operation of the sprinkler, the stops 100 and 101 are rotated together with the drive sleeve and spray head in a stepwise manner in one rotational direction until one of the stops is moved into a position with its stop surface 109 or 110 engaging the trip wire 112. When this occurs, the trip wire 112 is shifted to correspondingly rotationally shift the swirl plate 38 to its alternative position aligning the opposite set of swirl ports 36 or 37 with the water jets passing through the drive jet nozzles 35. Such switching of swirl plate position reverses the direction of water swirl within the drive case 26 thereby correspondingly reversing the direction of water turbine rotation and spray head rotational stepping movement. The sprinkler is thus reversed in direction and continues to operate in this manner until the other stop 100 or 101 is moved into engagement with the trip wire 112 whereupon the trip wire returns the swirl plate to its initial position to once again reverse the direction of sprinkler operation. Accordingly, the stop surfaces 109 and 110 of the two stops define the end limits of a preset arcuate path within which the water stream 24 (FIG. 2) is reversibly swept. Conveniently, for accurate projection of the stream 24 over desired terrain areas, the stop 100 on the drive ring 58 is positioned within the sprinkler housing in a preset rotational attitude relative to the external indicia 34 on the housing 12 so that the location of this end limit can be selectively chosen at the time of sprinkler installation.

Figure 20:
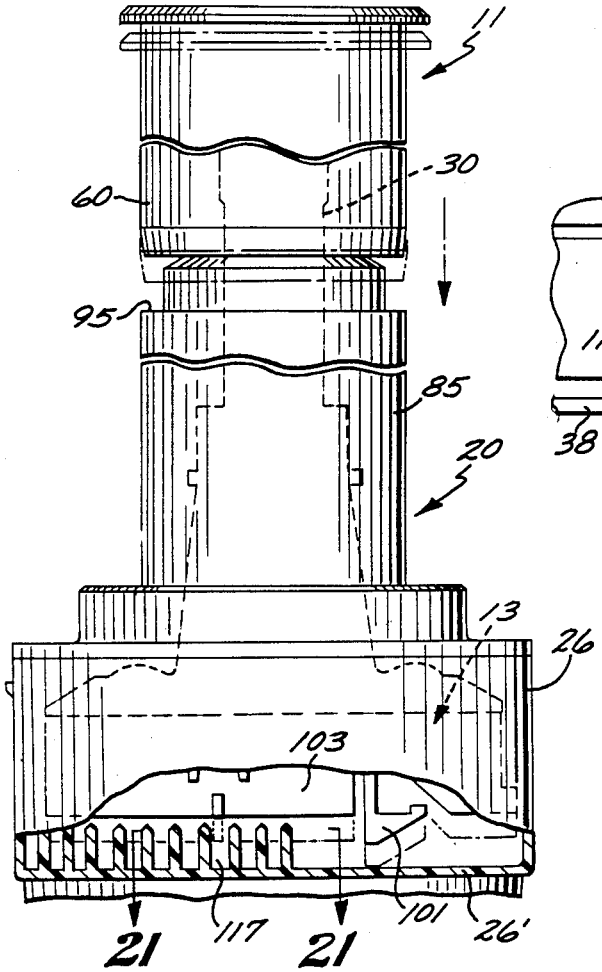
FIG. 20 is a fragmented vertical sectional view, shown partially in side elevation, illustrating adjustment of the reversing trip mechansim.
Figure 21:
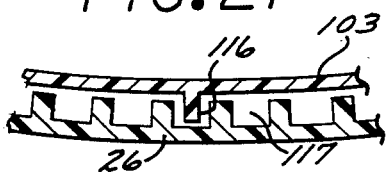
FIG. 21 is an enlarged fragmented vertical sectional view taken generally on the line 21—21 of FIG. 20.

The arcuate spacing between the stops 100 and 101 is quickly and easily adjustable by selective positioning of the stop 101 on the outer trip ring 103 while the sprinkler is operating, particularly upon sprinkler installation, as shown in FIGS. 20 and 21. More particularly, when adjustment is required, the spray head 11 and drive sleeve 30 are displaced downwardly through the above-described short stroke until the lower metering land 98 on the spray head base 60 seats upon the guide sleeve upper end 97 on the nonrotational riser 85 (FIG. 3). This downward movement is accommodated by the size of the recess 96 and displaces the outer trip ring 103 downwardly within the drive case 26 sufficiently to displace one or more outwardly radiating lugs 116 on the trip ring 103 into one of a plurality of radially inwardly open notches 117 formed within the drive case 26 (FIGS. 20 and 21). In this position, the outer trip ring 103 is locked against rotation within the drive case 26, whereby the spray head 11 and drive sleeve 30 can be rotated to displace the stop 100 relative to the thus-stationary stop 101. This rotation is permitted with minimum resistance by the ratcheted interengagement between the outer trip ring 103 and the inner drive ring 58 and may be performed in large or small increments or at any rotational position of the sprinkler. Release of the spray head 11 permits the spray head spring 88 to return the spray head and drive sleeve toward the normal upper position withdrawing the outer trip ring lugs 116 from the notches 117 and permitting continued rotation of the outer trip ring stop 101. If desired, the spray head 11 can be manually rotated without mechanical resistance back and forth within the adjusted arcuate path to immediately check the positions of the set end limits.

When the stops 100 and 101 are adjusted as desired, a vandal resistant collar 120 can be installed quickly and easily about the upper end of the riser 85 into the annular recess 96 vertically between the spray head base 60 and the riser land 95. Accordingly, the lock collar 120 provides a barrier blocking downward shifting of the spray head and drive sleeve thereby preventing engagement of the ring lug 116 with the drive case noches 117. The lock collar can be constructed or otherwise designed for substantial difficulty in removal thereby serving to prevent unauthorized adjustment in the relative preset positions of the stops 100 and 101.

In the event of attempted unauthorized tampering particularly such as by forced rotation of the spray head and drive sleeve beyond the end limits defined by the stops 100 and 101, the resilient trip wire 112 advantageously flexes sufficiently for nonrigid movement beyond either stop 100 or 101 without significant risk of breakage of any sprinkler component. The sprinkler can thus be temporarily maladjusted by rotation to a position aiming the projected water stream 24 toward an unintended adjacent terrain area. However, upon such occurrence, the sprinkler will resume rotational stepping operation in a normal manner and in the set direction for rotation back toward the preset part-circle path and engagement with one of the stops 100 or 101. Importantly, the outboard surfaces on these stops 100 and 101 facing in directions away from their upright trip surfaces 109 and 110 comprise ramped surfaces 121 and 122 over which the trip wire rides resiliently and smoothly without switching the position of the swirl plate 38. The trip wire thus rides over the associated ramped stop surface 121 or 122 and returns to the preset arcuate path for automatically resuming reversible part-circle operation as preset between the stops 100 and 101.

Figure 22:
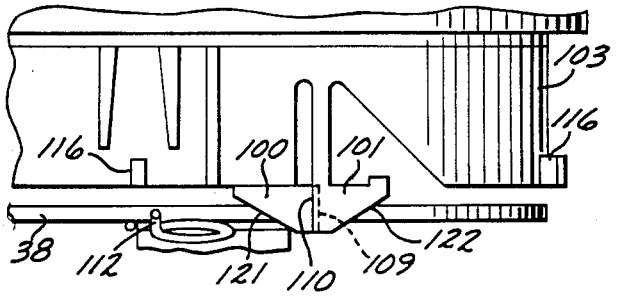
FIG. 22 is an enlarged fragmented vertical sectional view similar to FIG. 12 but illustrating the reversing trip mechanism in an alternative position of adjustment for full-circle sprinkler operation.
Figure 23:
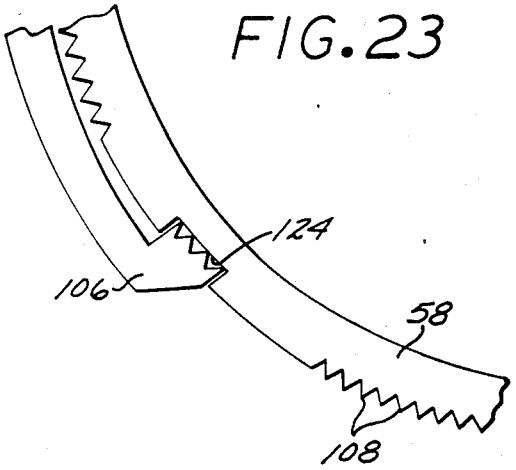
FIG. 23 is an enlarged fragmented view similar to FIG. 13 but illustrating a portion of the reversing trip mechanism when adjusted for full-circle sprinkler operation.

According to further aspects of the invention, the sprinkler can be adjusted quickly and easily to a full-circle setting position for rotational stepping motion continuously in either direction. This full circle setting position is obtained by adjusting the stops 100 and 101 as previously described to a position with their upright stop surface 109 and 110 oriented substantially face-to-face, as shown in FIG. 22. This permits the resilient trip wire 112 to ride smoothly in either direction over their ramped stop surfaces 121 and 122 which are now disposed in side-by-side relation without switching the operational state of the swirl plate 38. Conveniently, for enhanced nonvisual manual detection of the full-circle setting position, a detent 124 in the inner drive ring 58 receives the pawl 106 on the outer trip ring 103 when the full circle rotational position is obtained. Moreover, upon attempted adjustment for any setting position, the resilient finger 102 supporting the stop 101 cooperates with the resiliency of the trip wire to permit forced rotation beyond a position with the trip wire trapped between substantially face-to-face oriented stop surfaces 109 and 110 on the stops.

According to one further aspect of the invention, an improved seal means for the pop-up stem assembly 20 can be provided to prevent inadvertent entrapment of grit or other water borne particulate between the seal bearings 91 during adjustment of the reversing mechanism, as described above. More particularly, during an adjustment procedure, downward shifting of the spray head 11 and the drive sleeve 30 relative to the riser guide sleeve 86 increases the axial spacing between the opposed shoulders 92 and 93 which normally compressively retain the seal bearings 91 in sealing stacked relation preventing water flow to atmosphere between the guide sleeve interior and the drive sleeve exterior. This increased axial spacing potentially permits separation of the bearings 91 and subsequent entrapment of grit or the like between the bearings when the spray head and drive sleeve are released for resumed normal operation.

As shown in FIGS. 24–26, the improved seal means comprises an annular pressure-responsive restrictor seal 130 of a resilient seal material and a generaly downwardly open, U-shaped cross section. This restrictor seal is positioned concentrically about the drive sleeve 30 above an enlarged lip 132 thereon and beneath an overlying washer 134 which is retained in turn by the riser webs 87. An orifice 136 of small size is formed in the restrictor seal 130 to permit a small water flow into an elongated path defined cooperatively by an upwardly open channel 138 in the seal 130 and the washer 134, wherein this channel 138 opens ultimately into the chamber area 139 above the seal 130.

In operation, the restrictor seal 130 permits sufficient water leakage into the chamber area 139 during normal sprinkler operation to equalize pressures on opposite sides of the seal. Leakage to atmosphere is prevented by the closed stack of seal bearings 91 (FIG. 24). However, during adjustment of the reversing mechanism, the seal bearings 91 are subject to separation, as viewed in FIG. 26, thereby coupling the chamber area 139 to atmosphere. This results in a pressure differential across the restrictor seal which is then pressure-activated for sealing between the exterior of the drive sleeve 30 and the interior of the riser 85 to prevent significant water flow past the seal bearings 91. Upon return of the spray head and drive sleeve to a normal operating position accompanied by reclosure of the seal bearings 91, the orifice 136 permits refilling of the chamber area 139 to reestablish pressure equalization across the restrictor seal 130.

The improved ball drive sprinkler of the present invention thus provides a versatile rotary drive sprinkler having protected rotary drive components which can be adjusted easily for part-circle or full-circle operation in a manner resistant to unauthorized tampering including attempted maladjustments and attempted forced rotation. In addition, the sprinkler advantageously provides regulated water flow to a drive turbine for closely regulating turbine speed in a manner assuring constant rotational stepping of a spray head with minimum wear of mechanical components.

A variety of modifications and improvements to the improved sprinkler described herein are believed to be apparent to those skilled in the art. Accordingly, no limitation on the invention is intended by way of the description herein, except as set forth in the appended claims.

What is claimed is:

1. A rotary drive sprinkler, comprising:

a sprinkler housing adapted for connection to a supply of irrigation water;

a spray head for outward projection of an irrigation water stream and supported for rotation relative to said housing;

a rotary drive assembly for rotatably driving said spray head;

a reversing mechanism including means for reversing the direction of spray head rotation, within the end limits of a part-circle arcuate path, said reversing mechanism including resilient means permitting forced spray head rotation beyond either one of said end limits to a rotational position outside said part-circle path and upon subsequent spray head rotation for automatically returning to reversing rotation between said end limits within said part-circle path.

2. The rotary drive sprinkler of claim 1 wherein said rotary drive assembly includes means for disengaging from driving relation with said spray head upon forced rotation of said spray head.

3. The rotary drive sprinkler of claim 1 including means for adjusting the arcuate spacing between said end limits.

4. A rotary drive sprinkler, comprising:

a sprinkler housing adapted for connection to a supply of irrigation water;

a spray head for outward projection of an irrigation water stream and supported for rotation relative to said housing;

a rotary drive assembly for rotatably driving said spray head; and a reversing mechanism movable between forward- and reverse-drive positions for reversing the direction of spray head rotation, said reversing mechanism including a trip member for switching said mechanism between said forward- and reverse-drive positions, a first stop engageable with said trip member upon spray head rotation and shaped for moving said trip member to switch said mechanism upon spray head forward rotation and to permit trip member passage without switching said mechanism upon spray head reverse rotation, and a second stop engageable with said trip member upon spray head rotation and shaped for moving said trip member to switch said mechanism upon spray head reverse rotation and to permit trip member passage without switching said mechanism upon spray head forward rotation.

5. The rotary drive sprinkler of claim 4 wherein said first and second stops comprise an arcuately spaced pair of stops having stop surfaces facing each other and ramped surfaces facing away from each other.

6. The rotary drive sprinkler of claim 5 including means for adjusting the arcuate spacing between said first and second stops.

7. The rotary drive sprinkler of claim 4 wherein said trip member comprises a resilient trip wire.

8. The rotary drive sprinkler of claim 4 further including a pop-up stem assembly having said spray head mounted thereon and movable between a retracted position with said spray head substantially within said housing and a spraying position with said spray head elevated above said housing, said rotary drive assembly being rotatably coupled to said spray head via said pop-up stem assembly.

9. The rotary drive sprinkler of claim 8 wherein said rotary drive assembly and said pop-up stem assembly move as a unit between said retracted and spraying positions.

10. A rotary drive sprinkler, comprising:

a sprinkler housing adapted for connection to a supply of irrigation water;

a spray head for outward projection of an irrigation water stream and supported for rotation relative to said housing;

a rotary drive assembly for rotatably driving said spray head;

reverse means movable between forward- and reverse-drive positions for reversing the direction of rotary driving of said spray head;

a pair of arcuately spaced-apart stops defining the end limits of a part-circle path of spray head rotation, said stops having stop surfaces presented generally toward each other across said part-circle path and ramped surfaces presented generally away from said part-circle path; and a resilient trip member for switching said reverse means between said forward- and reverse-drive positions and extending to a normal position generally between said stops, said stops and said trip member being movable relative to each other upon spray head rotation to bring said trip member into engagement with said stop surfaces respectively at the opposite end limits of said part-circle path to switch the position of said reverse means to reverse the direction of spray head rotation;

said trip member having sufficient resiliency to move beyond either one of said end limits upon forced rotation of said spray head to a position outside said part-circle path and subsequently to ride over either one of said ramped surfaces without switching the position of said reverse means thereby returning to said normal position between said stops.

11. The rotary drive sprinkler of claim 10 wherein said trip member comprises a resilient trip wire extending from said reverse means to said normal position between said stops.

12. The rotary drive sprinkler of claim 11 further including means for supporting said reverse means against rotation with said spray head, and means for supporting said stops for rotation with said spray head, said stops being movable into engagement with said trip wire upon rotation of said spray head.

13. The rotary drive sprinkler of claim 11 further including means for adjusting the arcuate spacing between said stops.

14. The rotary drive sprinkler of claim 13 wherein said adjusting means includes means for moving said stops to a full-circle adjustment position with their stop surfaces substantially in face-to-face relation and with said trip wire disposed beyond said end limits whereby said spray head rotates continuously through a full-circle path in either rotational direction with said trip wire riding over said ramped surfaces without switching the position of said reverse means.

15. The rotary drive sprinkler of claim 10 wherein said rotary drive assembly includes means for rotatably driving said spray head in a succession of small rotational steps.

16. The rotary drive sprinkler of claim 10 further including a pop-up stem assembly having said spray head mounted thereon and movable between a retracted position with said spray head substantially within said housing and a spraying position with said spray head elevated above said housing, said rotary drive assembly being rotatably coupled to said spray head via said pop-up stem assembly.

17. The rotary drive sprinkler of claim 16 wherein said rotary drive assembly and said pop-up stem assembly move as a unit between said retracted and spraying positions.

18. The rotary drive sprinkler of claim 16 wherein said drive assembly comprises a balanced ball drive assembly.

19. The rotary drive assembly of claim 10 wherein said spray head includes a nozzle having an orifice formed therein of selected size, and further wherein said rotary drive means includes a water-driven turbine; and further including water flow regulation means having at least one drive jet nozzle for passage of a first portion of the water connected to said housing into driving relation with said turbine and then to said spray head, a first bypass port including a pressure compensating valve, and a second bypass port including a flow control bushing with an open flow opening therein of selected size in accordance with the size of said spray head nozzle orifice, said first and second bypass ports being for bypass passage of a second portion of the water around said turbine to said spray head, said jet nozzle and said first and second bypass ports being in parallel flow relation with each other.

20. The rotary drive sprinkler of claim 10 wherein said rotary drive means comprises a water-driven turbine and wherein said reverse means comprises a swirl plate having at least two oppositely angled swirl ports formed therein for swirl passage of water in opposite directions for rotatably driving said turbine in opposite directions.

21. The rotary drive sprinkler of claim 20 including a jet nozzle for passage of a water jet into driving relation with said turbine, said swirl plate being disposed between said turbine and said jet nozzle and movable between a forward-drive position with one of said ports aligned with said jet nozzle and a reverse-drive position with the other of said ports aligned with said jet nozzle.

22. The rotary drive sprinkler of claim 21 further including means for limiting swirl plate movement between said forward- and reverse-drive positions.

23. The rotary drive sprinkler of claim 10 wherein one of said stops is carried by a drive ring rotatable with said spray head and the other of said stops is carried by a trip ring releasably carried by said drive ring, and further including means supporting said spray head and said drive ring for movement relative to said rotary drive assembly between a normal operating position with said trip ring rotating with said drive ring and an adjustment position with said trip ring locked against rotation with said drive ring, said spray head and said drive ring being rotatable relative to said trip ring when in said adjustment position to adjust the arcuate spacing between said stops.

24. The rotary drive sprinkler of claim 23 wherein said other of said stops is resiliently carried by said trip ring.

25. The rotary drive sprinkler of claim 23 further including lock means for locking said spray head and said drive ring in their normal position relative to said rotary drive assembly thereby preventing adjustment of the arcuate spacing between said stops.

26. The rotary drive sprinkler of claim 23 wherein said trip ring is ratcheted about said drive ring.

27. The rotary drive sprinkler of claim 23 further including a drive case for said rotary drive assembly and supported against rotation within said sprinkler housing, said trip ring and said drive case including interengageable means for locking said trip ring against rotation when in said adjustment position.

28. The rotary drive sprinkler of claim 27 wherein said interengageable means comprises at least one lug projecting outwardly from said trip ring and means forming a plurality of open slots in said drive case for receiving said lug when said spray head and said drive ring are in said adjustment position.

29. The rotary drive sprinkler of claim 23 further including means for biasing said spray head and said drive ring toward their normal position.

30. The rotary drive sprinkler of claim 23 wherein said spray head and said supporting means cooperatively define a generally annular recess when said spray head and drive ring are in said normal operating position, and further including a lock collar receivable into said recess to prevent movement of said spray head and drive ring to said adjustment position.

31. The rotary drive sprinkler of claim 23 wherein said spray head comprises a pop-up spray head also movable between a retracted position substantially within said housing and a spraying position extending above said housing, said spray head being movable between said normal and adjustment positions while in said spraying position.

32. The rotary drive sprinkler of claim 31 further including a drive case for said rotary drive assembly and supported against rotation within said housing, said supporting means comprising a generally cylindrical riser secured to and upstanding from said drive case, and a drive sleeve rotatably supported within said riser, said drive sleeve being rotatable with said drive ring and said spray head, said supporting means further accommodating limited axial shifting movement of said drive sleeve relative to said riser to permit spray head movement between said normal and adjustment positions.

33. The rotary drive sprinkler of claim 32 further including spring means for urging said drive sleeve toward said normal position, primary seal means for preventing leakage between said riser and said drive sleeve when said drive sleeve is in said normal position, and secondary seal means acting between said riser and said drive sleeve to substantially prevent leakage therebetween when said drive sleeve is in said adjustment position.

34. The rotary drive sprinkler of claim 33 wherein said secondary seal means comprises a generally annular pressure-responsive seal interposed between said riser and drive sleeve, said seal including orifice means permitting relatively small leakage flow across said seal.

35. The rotary drive sprinkler of claim 33 wherein said spray head and said drive sleeve include snap-fit means for locking said spray head onto said drive sleeve.

36. The rotary drive sprinkler of claim 35 further including a drive lug on said drive sleeve for rotational driving engagement with said spray head.

37. The rotary drive sprinkler of claim 10 wherein said spray head comprises a pop-up spray head also movable between a retracted position substantially within said housing and a spraying position extending above said housing, said housing having a removable cap with an opening therein for movement of said spray head between said retracted and spraying positions, and further including a resilient seal member surrounding the cap opening and sealingly engaging said spray head, said seal member having an enlarged flange for overlying and sealing the juncture between said housing and said cap.

38. The rotary drive sprinkler of claim 23 including means for releasably detenting said trip ring relative to said drive ring when said stops are in an adjustment position with their stop surfaces disposed substantially face-to-face.

39. A rotary drive sprinkler, comprising:

a sprinkler housing adapted for connection to a supply of irrigation water;

a pop-up stem assembly including a spray head for outward projection of an irrigation water stream, said stem assembly being movable between a retracted position with said spray head substantially within said housing and a spraying position with said spray head elevated above said housing, said stem assembly further including a drive sleeve rotatably supporting said spray head with respect to said housing;

a rotary drive assembly movable with said stem assembly between said retracted and spraying positions, said rotary drive assembly including a drive case mounted against rotation within said housing and water-driven means for rotatably driving said drive sleeve;

first and second stops rotatable with said drive sleeve;

reverse means movable between forward- and reverse-drive positions for reversing the direction of rotational driving of said spray head by said drive sleeve; and a resilient trip member extending from said reverse means to a position engageable with said first and second stops upon spray head rotation, said first stop being shaped for moving said trip member to switch said reverse means upon forward spray head rotation and to permit trip member passage without switching said reverse means upon reverse spray head rotation, and said second stop being shaped for moving said trip member to switch said reverse means upon reverse spray head rotation and to permit trip member passage without switching said reverse means upon forward spray head rotation.

40. The rotary drive sprinkler of claim 39 wherein said first and second stops comprise an arcuately spaced pair of stops having stop surfaces facing each other and ramped surfaces facing away from each other.

41. The rotary drive sprinkler of claim 39 including means for adjusting the arcuate spacing between said first and second stops.

42. The rotary drive sprinkler of claim 39 wherein said first stop is carried by a drive ring rotatable with said spray head and said second stop is carried by a trip ring releasably carried by said drive ring, and further including means supporting said spray head and said drive ring for movement relative to said rotary drive assembly between a normal operating position with said trip ring rotating with said drive ring and an adjustment position with said trip ring locked against rotation with said drive ring, said spray head and said drive ring beng rotatable relative to said trip ring when in said adjustment position to adjust the arcuate spacing between said stops.

43. The rotary drive sprinkler of claim 42 further including lock means for locking said spray head and said drive ring in their normal position relative to said rotary drive assembly thereby preventing adjustment of the arcuate spacing between said stops.

44. The rotary drive sprinkler of claim 42 wherein said trip ring is ratcheted about said drive ring.

45. The rotary drive sprinkler of claim 42 further including a drive case for said rotary drive means and supported against rotation within said sprinkler housing, said trip ring and said drive case including interengageable means for locking said trip ring against rotation when in said adjustment position.

46. The rotary drive sprinkler of claim 42 further including means for biasing said spray head and said drive ring toward their normal position.

47. A rotary drive sprinkler, comprising:

a sprinkler housing adapted for connection to a supply of irrigation water;

a pop-up stem assembly mounted within said housing for movement between a retracted position substantially within said housing and a spraying position with a spray head thereon elevated above said housing for spraying irrigation water outwardly therefrom, said stem assembly further including a drive sleeve rotatably carrying said spray head;

a rotary drive assembly for rotatably driving said drive sleeve and said spray head in a succession of small rotational steps, said rotary drive assembly including a drive case nonrotationally supported within said housing, at least one water-driven turbine and means responsive to turbine rotation for driving said drive sleeve in a succession of small rotational steps;

reverse means for reversing the direction of rotation of said turbine, said reverse means including a swirl plate having at least two oppositely angled swirl ports for passage of water in opposite swirl directions in driving relation with said turbine;

means for directing a drive jet generally toward said turbine, said swirl plate being movable between a forward- and reverse-drive position with said swirl ports aligned respectively with said drive jet;

a resilient trip wire anchored at one end to said swirl plate for movement therewith and extending outwardly therefrom;

a first stop carried by drive ring; and a second stop carried by a trip ring releasably carried in turn about said drive ring;

said first stop being shaped for moving said trip wire to switch said swirl plate upon forward turbine rotation and to permit passage of said trip wire without switching said swirl plate upon reverse turbine rotation, said second stop being shaped for moving said trip wire to switch said swirl plate upon reverse turbine rotation and to permit passage of said trip wire without switching said swirl plate upon forward turbine rotation;

said drive sleeve and spray head being further movable relative to said drive case in the direction of movement between said retracted and spraying positions for movement between a normal operating position with said trip ring rotating with said drive ring and an adjustment position with said trip ring locked against rotation with said drive ring, said spray head and said drive ring being rotatable relative to said trip ring when in said adjustment position to adjust the arcuate spacing between said stops.

48. The rotary drive sprinkler of claim 47 wherein said rotary drive assembly comprises a ball drive assembly.

49. The rotary drive sprinkler of claim 47 further including lock means for locking said spray head and said drive ring in their normal position relative to said rotary drive assembly thereby preventing adjustment of the arcuate spacing between said stops.

50. The rotary drive sprinkler of claim 49 wherein said pop-up stem assembly further includes a riser secured to and upstanding from said drive case about said drive sleeve and spray head to define an open annular recess when said spray head and drive ring are in the normal position, said lock means comprising a lock ring seated within said recess to prevent movement of said spray head to said adjustment position.

51. The rotary drive sprinkler of claim 47 wherein said trip ring is ratcheted about said drive ring.

52. The rotary drive sprinkler of claim 51 further including means for vertically supporting said trip ring relative to said drive ring.

53. The rotary drive sprinkler of claim 47 further including spring means for biasing said spray head and said drive ring toward their normal position.

54. The rotary drive sprinkler of claim 47 wherein said spray head includes a nozzle having at least one orifice formed therein of selected size, and further including water flow regulation means having at least one drive jet nozzle for passage of a first portion of the water connected to said housing into driving relation with said turbine and then to said spray head, a first bypass port including a pressure compensating valve, and a second bypass port including a flow control bushing with an open flow opening therein of selected size in accordance with the size of said spray head nozzle orifice, said first and second bypass ports being for bypass passage of a second portion of the water around said turbine to said spray head, said jet nozzle and said first and second bypass ports being in parallel flow relation with each other.

55. The rotary drive sprinkler of claim 54 further including hood means for diverting said second portion away from said turbine.

56. The rotary drive sprinkler of claim 47 wherein said trip wire includes an intermediate loop.

57. The rotary drive sprinkler of claim 47 wherein said second stop is resiliently carried by said trip ring.

58. The rotary drive sprinkler of claim 51 wherein said trip ring includes a pawl engageable with ratchet teeth on said drive ring, said stops each having a generally upright stop surface for engagement with said trip wire to switch the position of said swirl plate and a ramped surface for engagement with said trip wire without switching the position of said swirl plate, said drive ring beng movable relative to said trip ring to adjust said first and second stops to a full-circle position with their stop surfaces disposed substantially face-to-face, said pawl being releasably seatable within a detent in said drive ring when said stops are in said full-circle position.

59. The rotary drive sprinkler of claim 50 further including primary seal means for preventing leakage between said riser and said drive sleeve when said drive sleeve is in said normal position and secondary seal means acting between said riser and said dirve sleeve to substantially prevent leakage therebetween when said drive sleeve is in said adjustment position.

60. The rotary drive sprinkler of claim 59 wherein said secondary seal means comprises a seal ring interposed between said drive sleeve and riser and having a generally U-shaped cross section opening in an upstream direction, and a seal water interposed between said drive sleeve and riser on the downstream side of said seal ring, said seal ring and seal washer cooperatively defining an elongated leakage path for a small leakage flow across said secondary seal means.

* * * * *